United States Patent [19]

Balls et al.

[11] 4,424,453

[45] Jan. 3, 1984

[54] KEY-OPERATED DEVICE FOR SAVING ELECTRICAL ENERGY

[76] Inventors: Nigel P. Balls, 30 Commonfields, West End, Woking, Surrey; Raymond B. Brill, 29 Ham St., Ham, Richmond, Surrey, both of England

[21] Appl. No.: 250,871

[22] Filed: Apr. 3, 1981

[30] Foreign Application Priority Data

Apr. 8, 1980 [GB] United Kingdom ..... 8011618
Sep. 2, 1980 [GB] United Kingdom ..... 8028247

[51] Int. Cl.[3] ..... H01H 19/04; H01H 27/06
[52] U.S. Cl. ..... 307/112; 200/44
[58] Field of Search ..... 307/132 E, 142, 112; 200/51 R, 44; 219/497; 355/40 FP

[56] References Cited

U.S. PATENT DOCUMENTS

| | | | |
|---|---|---|---|
| 2,835,830 | 5/1958 | Rathenau | 307/112 UX |
| 3,246,178 | 4/1966 | Comstock et al. | 307/142 X |
| 3,829,661 | 8/1974 | Silverman et al. | 355/40 FP UX |
| 4,002,956 | 1/1977 | Minor et al. | 307/142 X |
| 4,063,110 | 12/1977 | Glick | 307/112 |
| 4,107,484 | 8/1978 | Petersen | 200/44 X |
| 4,280,118 | 7/1981 | Brunken et al. | 200/44 X |
| 4,323,762 | 4/1982 | Ervin et al. | 307/142 X |

FOREIGN PATENT DOCUMENTS 385847 1/1933 United Kingdom .

*Primary Examiner*—Donald A. Griffin
*Attorney, Agent, or Firm*—Shenier & O'Connor

[57] ABSTRACT

A key-operated device is situated in accommodation, such as a hotel room, and controls the electrical power supply to at least one electrical outlet in the accommodation. When a key is received in the device in an actuating position, a microswitch is caused to be actuated and connects the supply. When the key is removed from the device the microswitch is deactuated and the power supply to the electrical devices is disconnected. The microswitch is connected via a connector to the mains power supply and a fuse box for the various electrical circuits to be controlled in the accommodation. The key to operate the device is the same key as, or is securely attached to, the key required for opening the door of the accommodation. Thus, the wastage of electrical energy is prevented by ensuring that all electrical devices, e.g. televisions, heaters, lights, air conditioning units, whose power supplies are controlled by the device, are turned off when the occupant leaves the accommodation for a period taking his key with him.

7 Claims, 8 Drawing Figures

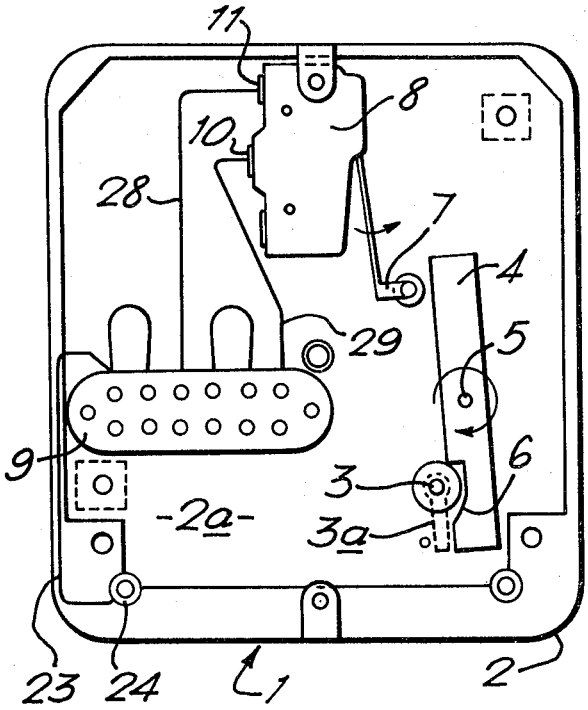
FIG.1.
FIG.1A.
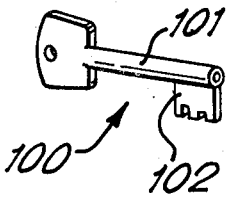
FIG.2.
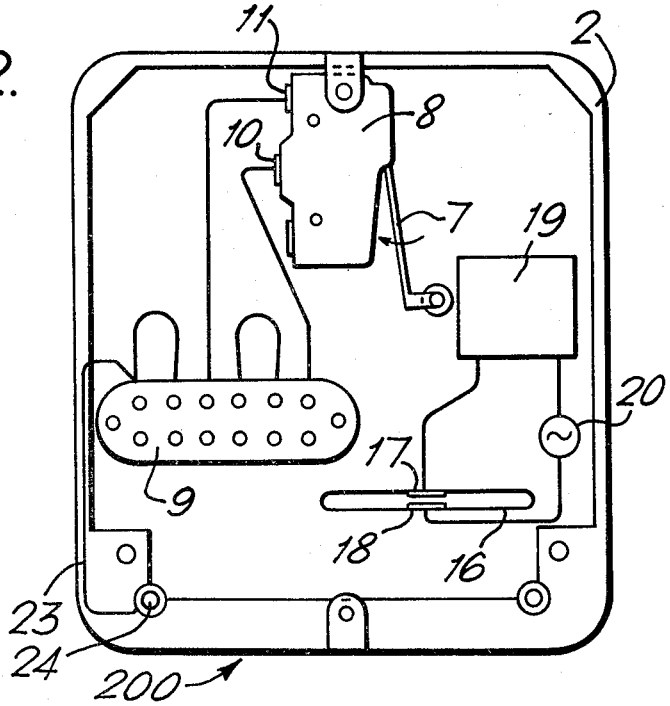
FIG.2A.
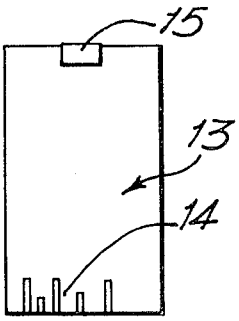

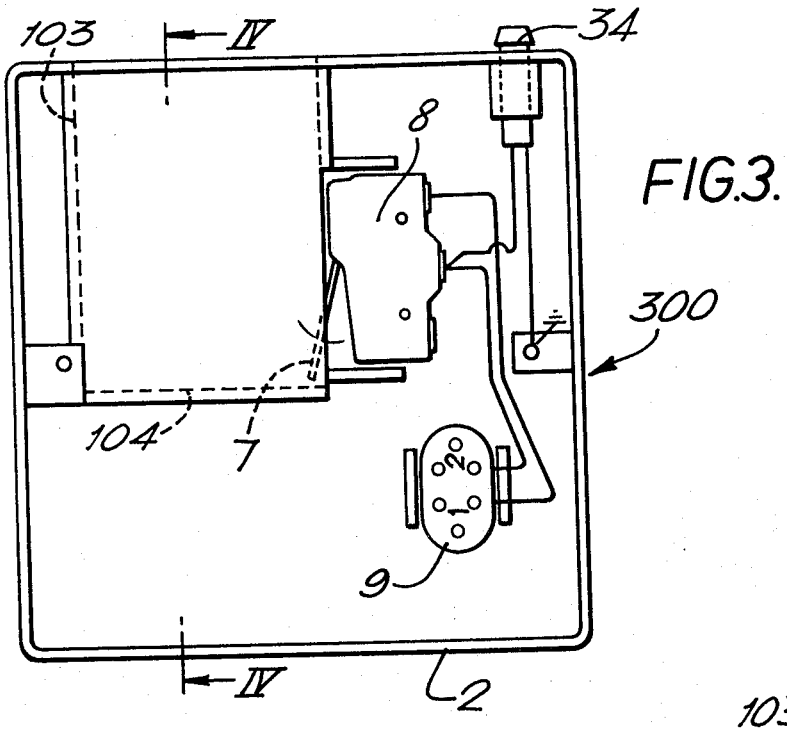
FIG.3.
FIG.3A.
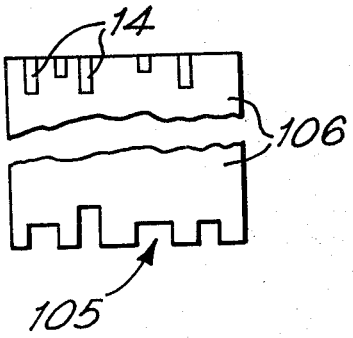
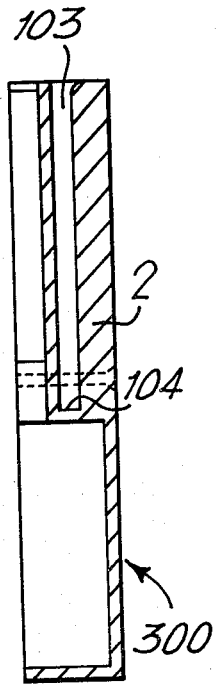
FIG.4.

KEY-OPERATED DEVICE FOR SAVING ELECTRICAL ENERGY

This invention relates to saving electrical energy in accommodation, which may comprise a single room or a group of rooms, to which access is via a lockable door.

The invention is particularly applicable to accommodation in hotels and motels. Guests staying in hotels or motels frequently leave their accommodation for long periods without switching off the lights and electrical devices such as television sets, heaters and air conditioning units which are not required to be left on. This is wasteful of electrical energy and costly to the owner of the accommodation.

An object of this invention is to at least reduce the possibility of such waste of electrical energy.

In each of the embodiments of the invention described hereinafter we provide a key operated device which controls the supply of electrical power to at least one electrical outlet associated with the accommodation. The device requires the presence of a key, which is preferably the same key as, or is securely attached to, the key to the door of the accommodation, to connect the supply. Thus, when the guest leaves the accommodation he requires the key to lock the door if the door is not self-locking, and subsequently to unlock the door to regain access to the accommodation. Accordingly the guest has to remove the key from the key operated control device and thus he automatically disconnects the supply to those electrical outlets controlled through the device. It is to be understood that the term 'outlets' is intended to refer to permanent electrical connections of electrical devices and appliances as well as sockets into which electrical devices and appliances may be plugged. Thus, for example the supply may be automatically disconnected to all or some of the lights and permanently wired installations such as air conditioners.

In accordance with the invention, there is provided a system for saving electrical energy in accommodation to which access is via a lockable door, said system comprising a key-operated device including switch means for controlling the supply of electrical power to at least one electrical outlet associated with the accommodation; and a key unit for both unlocking the door and operating said device, which key unit comprises at least one key; said switch means being arranged to connect said supply when the key unit is received in the device in an actuating position and to disconnect said supply when the key unit is removed from the device.

It is to be understood that the key unit may comprise a single key which is adapted to unlock the door and operate the device. Alternatively the key unit may comprise individual keys for performing these functions which keys are securely connected together so that they cannot be readily separated by the guest. Where a single key is used it may comprise a rotatably acting metal key or a card key. Where individual keys are used, each key may be a rotatably acting metal key, each key may be a card key or one key may be a rotatable metal key and the other key may be a card key secured to the metal key in the manner of a key fob.

In order that the invention may be well understood some embodiments thereof, which are given by way of example only, will now be described in detail, reference being had to the accompanying drawings in which:

FIG. 1 is a schematic plan view of one key-operated device of a system embodying the invention;

FIG. 1A is a view of a key for the device shown in FIG. 1;

FIG. 2 is a similar view to FIG. 1 showing an alternative key-operated device;

FIG. 2A is a plan view of a card-key for the device shown in FIG. 2;

FIG. 3 is a similar view to FIG. 1 showing a further alternative key-operated device;

FIG. 3A is a fragmentary view of a modified card key for the device shown in FIG. 3;

FIG. 4 is a view along the line IV—IV in FIG. 3; and

Like reference numerals in the drawings indicate like parts.

Figure 5:
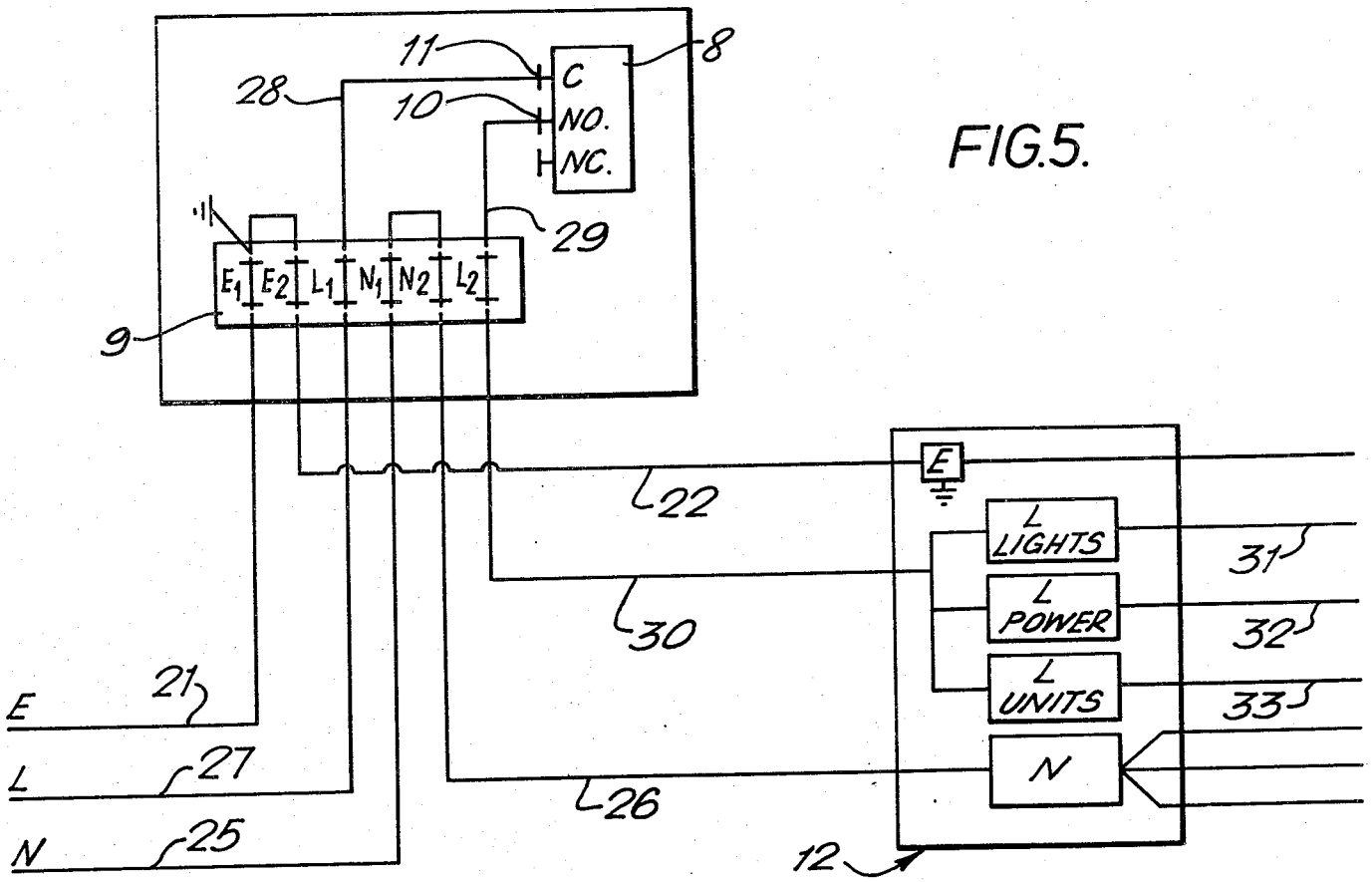
FIG. 5 is a circuit diagram showing one way in which any one of the devices shown in FIGS. 1, 2 and 3 may be utilised in a system for saving electrical energy.

Referring first to FIG. 1, a key-operated device 1 is shown with the front cover of its housing 2 removed for the purpose of illustration. The front cover has a key aperture, the relative position of which is indicated in dotted line at 3*a*, for receiving a rotatably acting metal key 100 which as illustrated in FIG. 1A includes a hollow shaft 101 and an operating flange 102. The flange 102 is castellated and designed to operate the lock of a door to the accommodation in which the device 1 is situated. When the key is received in the device 1 by being inserted through the aperture 3*a*, the hollow shaft 101 fits over and is located by a fixed spindle 3 which extends from the base 2*a* of the housing. When the key is turned counter-clockwise its flange 102 engages a recess 6 of a lever 4 which is biased clockwise about pivot 5 by spring means (not shown) as indicated by the arrow in FIG. 1 to the limit position illustrated in FIG. 1. Rotation of the key counter-clockwise through 90 degrees into an actuating position causes the lever 4 to rotate counter-clockwise about pivot 5 and cooperate with a counter-clockwise biased actuating member, or lever, 7 of a switch means of the device which comprises a microswitch 8 to move the member 7 against its bias to actuate the microswitch.

The microswitch 8 controls the mains power supply to electrical outlets wired through the device 1—when actuated the microswitch completes the line path of the mains power supply which is taken from connector 9 in the device via lead 28 to terminal 11 of microswitch 8 and from terminal 10 of the microswitch back to connector 9 via lead 29.

When the key is removed from the device 1, the lever 4 and thus the actuating member 7 return under their respective biases to the positions illustrated in FIG. 1 and the microswitch is deactuated thereby disconnecting the line path through the microswitch.

Whilst it is envisaged that the key flange 102 for operating the door lock will be used for operating the device it is to be understood that the key could be provided with a separate flange, which would not interfere with operation of the door lock, for operating the device. Furthermore individual keys for the door and device securely fastened together into a key unit could be used, the flange of the key for the device comprising a blank.

An alternative device 200 is illustrated in FIG. 2. This device 200 is designed to be operable by a modified 'card-type' key 13 shown in FIG. 2*a*. Such card keys may be made of a thin plastics plate provided at one end with magnetic coding elements 14 which serve to operate the door lock. In order to make such a key suitable for use with the device 200 a current path between opposite side faces of the key is provided. One way of doing this is by wrapping a conducting foil 15 round the end edge of the key remote from the magnetic coding elements 14. The foil 15 extends inwardly from the edge over both side faces of the key so that when the key 13 is inserted through key aperture 16 into an actuating position, in which it is retained by spring pressure means (not shown), a current path is provided via foil 15 between contacts 17 and 18 formed on either side of the slot shaped aperture 16. When the key 13 completes the current path it connects a solenoid 19 to its power supply 20, which may be the mains power supply. The solenoid 19 is arranged to cause actuation of microswitch 8, and thus connection of the line path through the microswitch, by movement of actuating arm 7 against its clockwise bias in response to the magnetic field of solenoid 19 when it is connected to its power supply. As soon as the key 13 is removed from the aperture, solenoid 19 is disconnected and ceases to actuate the microswitch 8 whereby the line path through the microswitch is disconnected. The rest of the circuitry of device 200 is similar to that of device 1 illustrated in FIG. 1.

Another, and presently preferred, key operated device 300 is illustrated in FIGS. 3 and 4. The housing 2 has a recess 103 for receiving a card key and into which recess a clockwise biased actuating member, or lever, 7 of microswitch 8 projects whereby when the card key is fully inserted into the recess 103 into an actuating position it engages and moves the actuating member 7 against its bias to actuate the microswitch 8 to connect the line path through the microswitch 8. The card key is retained in the recess 103 in its actuating position until positively removed therefrom by its engagement with the biased actuating member 7. This device 300 is provided with a pilot neon bulb 34 which is located in the housing adjacent the entry of the recess 103 and is connected to the microswitch such that the bulb is lit when the microswitch connects the line path through it.

As will be understood removal of the card key from the recess 103 allows the actuating member 7 to return to the position illustrated in FIG. 3 such that the microswitch ceases to be actuated and the line path through the microswitch is disconnected.

In this embodiment, the card key acts mechanically to operate the device 300 and preferably has magnetic coding elements which serve to operate the lock of the door to the accommodation in which the device 300 is situated. However, it will be appreciated that the card key for the device may be separate from the key for the door, which may be a metal rotatably acting key or a further card key which is securely connected with the card-key for the device to form a key unit which the guest has to take with him when leaving the accommodation in order to regain access to the accommodation if the door thereto has been locked. In either case, as the card key for the device 300 acts mechanically by virtue of its engagement with the actuating member 7 it may be desirable to form the base 104 of the slot which is shown as flat in FIGS. 3 and 4 instead with castellations—or some other shaping—to correspond with shaping, such as that shown at 105 on the card key 106 illustrated in FIG. 3A so that only a key with the correct shaping can be inserted far enough into the recess to engage the member 7 to actuate the microswitch.

A circuit by which any of the above described devices may be made to control the electrical power supply of at least one electrical outlet in accommodation is illustrated in FIG. 5. The three lines of the mains power supply are indicated as Earth E, Line L and Neutral N. The earth is connected through line 21, connector 9 and line 22 to the earth in a fuse box 12. An earth line 23 connected to the housing 2 is also connected via connector 9 to the mains earth. The neutral line 25 is connected through the connector 9 direct to line 26 and fuse box 12. The line L is connected via line 27, connector 9 and line 28 to terminal 11 of the microswitch 8. When the microswitch 8 is actuated, that is only when the key is received in the device in its actuating position, a current path is provided between terminals 11 and 10 of the microswitch 8 and current passes through line 29 connector 9 and line 30 to the fuse box 12. The fuse box 12 can control all or some of the circuits in the room. In FIG. 5 the fuse box is shown as supplying power to three circuits, a circuit 31 for, say, the lights in the room, a circuit 32 for the power sockets into which circuit such electrical devices as kettles and television sets may be plugged, and a circuit 33 for any special units such as heaters or air conditioning units. The neutral and earth lines for these three circuits are likewise derived from the incoming neutral and earth lines 26 and 22. When the key is removed from the device there is no current path between terminals 11 and 10 of the microswitch so that power supply to the fuse box 12 is interrupted.

It may be desirable to use the described devices to control only some of the room circuits which provide power to the higher power rated devices in the room.

It will be appreciated that alternative circuit arrangements may be utilised and also other means of using a key to operate the device provided that the key remains in the device during the whole period that power is to be supplied to the circuits controlled by the device, the supply of power being interrupted as soon as the key is removed from the key aperture.

It will be appreciated that as the key used to operate the device is preferably the door key or is at least permanently secured to the door key, it is necessary to remove the key from the device before leaving and locking the room and that such removal will automatically disconnect the supply to circuits controlled by the device.

As well as hotel and motel rooms the described system can be successfully used whenever electrical energy is to be conserved as for example in schools, offices or public buildings and the term accommodation as used herein is to be construed accordingly.

Having thus described our invention what we claim is:

1. A system for saving electrical energy in accommodation to which access is by a lockable door, said system comprising a key-operated device including switch means for controlling the supply of electrical power to at least one electrical outlet associated with the accommodation; and a single key insertable in said device and movable to an actuating position for both unlocking the door and operating said device, said switch means being arranged to connect said supply to said outlet only when the key is present in the device and in an actuating position and to disconnect said supply from said outlet when the key is removed from the device.

2. A system as claimed in claim 1, wherein said device comprises solenoid means having a power supply circuit arranged to be completed when the key unit is received in the device in the actuating position, which solenoid means are operable to actuate the switch means to connect said supply only when the key unit completes the power supply circuit of the solenoid.

3. A system as claimed in claim 1, wherein the switch means comprises an actuating member cooperable with the key unit and arranged to actuate the switch means to connect the supply only when the key unit is received in the device in the actuating position.

4. A system as claimed in claim 1, further comprising a fuse box for controlling the power supply of said at least one electrical device, and wherein the switch means is arranged to control the power supply to the fuse box.

5. A system for saving electrical energy in accommodation to which access is by a lockable door, said system comprising a key operated device including switch means for controlling the supply of electrical power to at least one electrical outlet associated with the accommodation; and a card key which is magnetically coded for opening the door and which is adapted to mechanically operate on the switch means, the switch means being arranged to connect said supply to said outlet when the key is present in the device in an actuating position and to disconnect said supply from said outlet when the key is removed from the device.

6. A system for saving electrical energy in accommodation to which access is by a lockable door, said system comprising a key-operated device including switch means for controlling the supply of electrical power to at least one electrical outlet associated with the accommodation; and a key unit for both unlocking the door and operating said device, which key unit comprises at least one key; said switch means being arranged to connect said supply to said outlet only when the key unit is present in the device and in an actuating position and to disconnect said supply from said outlet when the key unit is removed from the device, said key unit comprising a single card key, a first portion of which is adapted to unlock said door and a second portion of which is adapted to operate said device.

7. A system for saving electrical energy in accommodation to which access is by a lockable door, said system comprising a key-operated device including switch means for controlling the supply of electrical power to at least one electrical outlet associated with the accommodation; and a key unit for both unlocking the door and operating said device, which key unit comprises at least one key; said switch means being arranged to connect said supply only when the key unit is present in the device in an actuating position and to disconnect said supply from said outlet when the key unit is removed from the device, said device comprising a lever mechanism cooperable with the key unit when the key unit is received in the device and arranged to actuate the switch means to connect said supply only when the key unit is in the actuating position.

* * * * *